US012599834B2

(12) United States Patent
Alonso Perez

(10) Patent No.: US 12,599,834 B2
(45) Date of Patent: Apr. 14, 2026

(54) GAME BOX ELEMENT FORMING THE LID OF A GAME BOX OR GAME BOARD, ASSOCIATED GAME BOX

(71) Applicant: GAMEGENIC GMBH, Essen (DE)

(72) Inventor: Alberto Adrian Alonso Perez, Eggenstein-Leopoldshafen (DE)

(73) Assignee: GAMEGENIC GMBH, Essen (DE)

( * ) Notice: Subject to any disclaimer, the term of this patent is extended or adjusted under 35 U.S.C. 154(b) by 659 days.

(21) Appl. No.: 17/918,942

(22) PCT Filed: Apr. 16, 2021

(86) PCT No.: PCT/EP2021/059938
§ 371 (c)(1),
(2) Date: Oct. 14, 2022

(87) PCT Pub. No.: WO2021/209610
PCT Pub. Date: Oct. 21, 2021

(65) Prior Publication Data

US 2023/0277918 A1 Sep. 7, 2023

(30) Foreign Application Priority Data

Apr. 16, 2020 (FR) ..... 2003844
Feb. 19, 2021 (FR) ..... 2101653

(51) Int. Cl.
*A63F 3/00* (2006.01)

(52) U.S. Cl.
CPC ..... *A63F 3/00895* (2013.01); *A63F 3/0023* (2013.01); *A63F 2003/00252* (2013.01);
(Continued)

(58) Field of Classification Search
CPC ..... A63F 3/00895; A63F 3/0023; A63F 2003/00252; A63F 2003/00391;
(Continued)

(56) References Cited

U.S. PATENT DOCUMENTS 5,478,085 A 12/1995 Canner et al.
6,203,017 B1 * 3/2001 Schultz ..... A63F 3/0023 273/287

(Continued)

FOREIGN PATENT DOCUMENTS

CN 208097404 11/2018
DE 202004005235 U1 6/2004

(Continued)

OTHER PUBLICATIONS

International Search Report for PCT/EP2021/059938 dated Apr. 16, 2021.

(Continued)

*Primary Examiner* — James S. McClellan

(74) *Attorney, Agent, or Firm* — B. Aaron Schulman, Esq.; Stites & Harbison, PLLC

(57) ABSTRACT

The invention relates to a game element (1*a*), preferably of a board game box (B1, B2, B3) comprising: —a central portion (10*a*) comprising four sides (11*a*, 12*a*, 13*a*, 14*a*); —side portions (15*a*, 16*a*, 17*a*, 18*a*) each connected to one side (11*a*, 12*a*, 13*a*, 14*a*) of the central portion (10) so that the side portions (15*a*, 16*a*, 17*a*, 18*a*) can be moved from a first position (P0) to a second position (P1): —the first position (P0) being a position in which said member (1*a*) is flat; —the second position (P1) being a position wherein the side portions are raised relative to the central portion (10*a*) so that said member (1*a*) forms a game board for a board game.

11 Claims, 14 Drawing Sheets

(52) U.S. Cl.
CPC ..... *A63F 2003/00391* (2013.01); *A63F 2003/00952* (2013.01); *A63F 2003/00962* (2013.01); *A63F 2250/601* (2013.01)

(58) Field of Classification Search
CPC . A63F 2003/00952; A63F 2003/00962; B65D 81/36
See application file for complete search history.

(56) References Cited

U.S. PATENT DOCUMENTS

| | | | | |
|---|---|---|---|---|
| 8,590,721 | B2 | 11/2013 | Pasi | |
| 10,660,734 | B1 * | 5/2020 | Chapman | B65B 23/00 |
| 2004/0007814 | A1 | 1/2004 | Senart | |
| 2004/0207298 | A1 | 10/2004 | Rodon et al. | |
| 2006/0169690 | A1 * | 8/2006 | Rothschild | A47G 9/062 220/7 |
| 2006/0208062 | A1 | 9/2006 | Osborn et al. | |
| 2007/0057463 | A1 * | 3/2007 | Del Rincon | A63F 3/00028 273/285 |
| 2009/0058003 | A1 * | 3/2009 | Nouhan, Jr. | A63F 3/02 229/103 |
| 2010/0147839 | A1 | 6/2010 | Pasi | |
| 2010/0181311 | A1 | 7/2010 | Costecalde | |
| 2013/0095723 | A1 * | 4/2013 | Sadri | A63H 33/16 446/101 |
| 2014/0033660 | A1 | 2/2014 | Shigeta | |
| 2016/0280415 | A1 | 9/2016 | McDonald et al. | |
| 2018/0339837 | A1 * | 11/2018 | Fitt | B65D 11/1866 |
| 2020/0180814 | A1 * | 6/2020 | Timpson | B65D 5/243 |

FOREIGN PATENT DOCUMENTS

| | | |
|---|---|---|
| DE | 20 2015 103 334 | 7/2015 |
| EP | 3160869 | 8/2018 |
| FR | 1111669 | 3/1956 |
| FR | 2734735 | 12/1996 |
| GB | 2470055 | 11/2010 |
| GB | 207323 | 11/2023 |
| KR | 102167656 | 10/2020 |
| WO | WO 9916675 | 4/1999 |

OTHER PUBLICATIONS

International Search Report and Written Opinion for PCT/EP2021/059938 dated Jul. 15, 2021.
Preliminary Search Report for FR 2003844 dated Dec. 11, 2020.
Office Action dated Dec. 30, 2024 in corresponding Chinese Application No. 202180028712.2.
Jan. 30, 2026 in related U.S. Appl. No. 18/546,441.

* cited by examiner

GAME BOX ELEMENT FORMING THE LID OF A GAME BOX OR GAME BOARD, ASSOCIATED GAME BOX

GENERAL TECHNICAL FIELD AND STATE OF THE ART

The invention relates to a board game box, particularly comprising a lid that can be used as a game board and a tray for storing board game equipment such as playing cards.

A board game box allows storing board game equipment such as playing cards, one or several dice(s), a game board, etc.

To store this equipment, the box is often bulky and ultimately only used for storage.

Furthermore, in the case of games using cards, it is often necessary to be able to store them suitably so as not to damage them. Finally, card games often require a card holder or card dispenser facilitating access to the cards by the players.

PRESENTATION OF THE INVENTION

The invention proposes a game element, preferably a game box that can be used as a lid, a game mat and as well as a game box comprising such an element.

As such, the invention proposes, according to a first aspect, a game element, preferably a board game box comprising:

- a central part comprising four sides;
- side parts each being connected to one side of the central part such that the side parts can switch from a first position to a second position:
  - the first position being a position such that said element is flat;
  - the second position being a position where the side parts are raised relative to the central part so that said element forms a game board for a board game.

The invention, according to the first aspect, is advantageously completed by the following characteristics, taken alone or in any one of their technically possible combinations:

- the side parts are further movable so that the element is in a third position to form a lid of a board game box;
- it comprises eight holding parts, each holding part being disposed between two side parts, the holding parts being connected with an adjacent side part and another holding part so as to be able to hold the side parts in the raised position when said element forms a game board.
- the holding parts comprise connecting means configured to connect in pairs adjacent holding parts when said element forms a game board.
- the connecting means consist of magnets or textile strips comprising hooks such as Velcro™ or adhesives or press knobs.
- the side parts are connected to the sides of the central part via first fold lines;
- the holding parts are connected in pairs via second fold lines;
- it comprises third fold lines each extending from one edge of a side part to one edge of another side part, facing it, the fold lines making it possible to fold said U-shaped element to form a U-shaped lid for a board game box.

The invention proposes a game box comprising a tray for storing game equipment and a lid that can be transformed into a game mat. The lid being transformable, the size of the box is smaller than a box that would have been necessary to at least store the game mat.

Thus, according to a second aspect, the invention proposes a board game box comprising: a tray adapted to contain board game equipment; an element according to the first aspect of the invention forming a lid for said tray or game board.

The invention, according to the second aspect, is advantageously completed by the following characteristics, taken alone or in any one of their technically possible combinations:

- the tray comprises a first container and a second container, the second container being disposed above the first container and is assembled with the first container so as to be movable relative to the first container in order to make the first container accessible.
- the second container is movably mounted relative to the first container by means of rods, at least one rod connecting the first container to the second container in order to allow deployment of the second storage area relative to the first storage area.
- the rods comprise orifices and are connected to the first and second containers by means of pins forcibly mounted in the orifices of the rods to forcibly hold the rods in corresponding orifices on outer faces of the first and second containers.
- each container comprises compartments adapted to store board game equipment.
- the first container comprises a bottom and edges, one edge being adapted to be unfolded in order to be parallel to the bottom so as to facilitate access to the first container.
- the outer faces of the first container and second container are covered with a shell for hiding the rods.
- it comprises a tray and an element according to the preceding claim 5 forming a U-shaped lid for said tray.
- it comprises a drawer, the drawer comprising a rectangular bottom; three walls perpendicular to the bottom and rising respectively from three sides of the bottom; a fourth wall movably mounted relative to a fourth side to be actuated between a high position such that the four walls close the sides of the bottom and a low position such that one side is accessible; means for returning the fourth movable wall to bring it back to the high position when it starts to be raised.
- the drawer comprises two intermediate walls extending from the accessible side when the movable wall is in the low position, the walls being disposed at each end of the accessible side, the movable wall being in contact with the intermediate walls when it is in the high position.
- the means for returning the movable wall of the drawer consist of complementary magnetized parts disposed on the intermediate walls and the movable wall such that the movable wall is attracted towards its high position when it is raised.
- the bottom of the drawer comprises a step extending from the edge of the accessible side such that the bottom comprises a positive elevation from the edge of the accessible side.

The invention proposes a storage tray for a game box comprising several compartmentalized levels for the storage of game equipment such as playing cards.

Thus, the cards are properly stored. Furthermore, the tray can be used as a card dispenser to allow the different players to access the cards easily.

PRESENTATION OF THE FIGURES

Other characteristics, aims and advantages of the invention will emerge from the following description, which is purely illustrative and not limiting, and which should be read in relation to the appended drawings in which.

In all the figures, similar elements bear identical references.

DETAILED DESCRIPTION

It is specified in the following that "box" means a storage tray provided with a lid.

In the following, several game boxes comprising a lid and a storage tray will be described. The lid is advantageously convertible/transformable into a game board which can preferably switch from a flat or planar position to a position with raised edges.

It is specified that "game board" means an area in which the game takes place. This may be a dice rolling area or an area comprising markings allowing the game to take place. One example of game boards is the goose or checkers game board, which are games well known to those skilled in the art (non-exhaustive examples).

The lid allows closing the storage tray. As will be detailed later, the storage tray can be used alone or in combination with the lid.

Also, the lid, when used alone, is a game board that can take two positions. It will be understood in this case that it is a game board which can comprise the two positions mentioned above. The flat position allows stowing it or transporting it easily.

The box allows the storage of game equipment such as playing cards, one or several dice(s), one or several pawn(s), etc. This list is not exhaustive and those skilled in the art can understand that the box can store any element(s) useful for a board game.

First Embodiment

Figure 2:
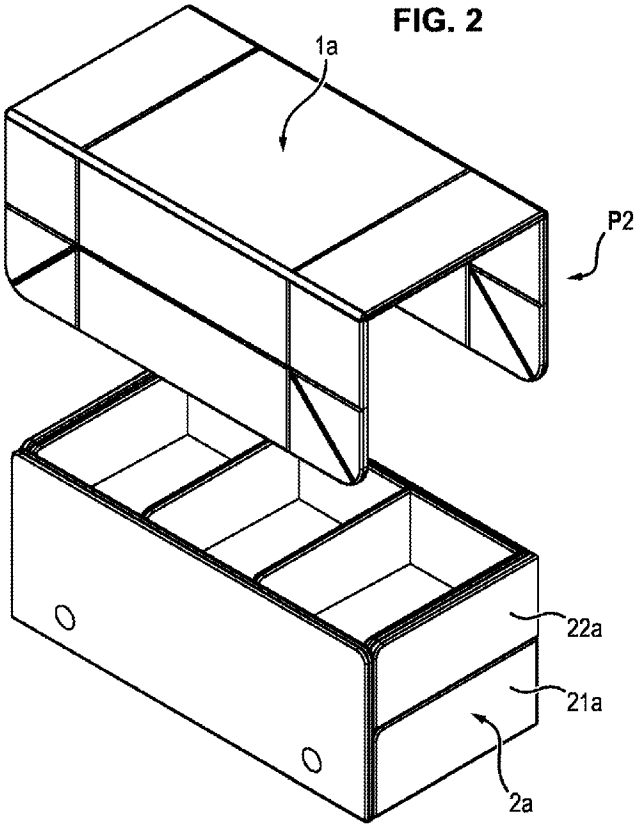
FIG. 2 illustrates an exploded view of a board game box according to one embodiment of the invention.
Figure 1:
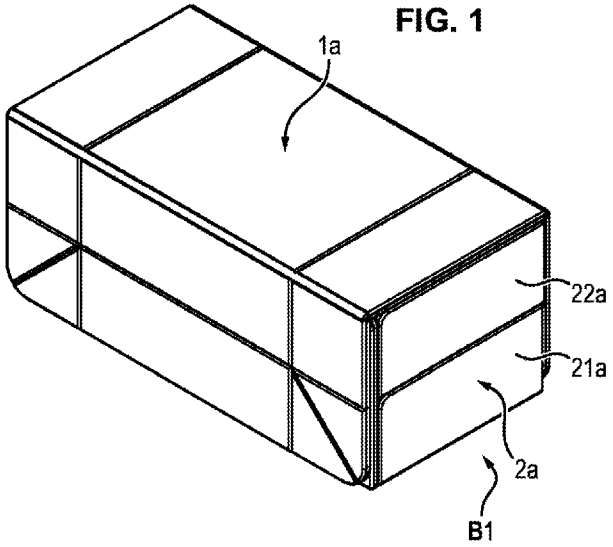
FIG. 1 illustrates an assembled view of a board game box according to one embodiment of the invention.

FIGS. 1 and 2 illustrate a board game box B1 comprising a lid 1*a* and a storage tray 2*a* according to a first embodiment.

As will be specified in more detail, the game box B1 comprises a storage tray 2*a* constituted by several superimposed possibly compartmentalized containers, one or several of them 21, 22 being able to be deployed. This allows having a compact storage tray 2*a* while making it possible to have an optimized and accessible storage space.

Lid 1*a*/Transformable Game Board 1*a*

Figure 3:
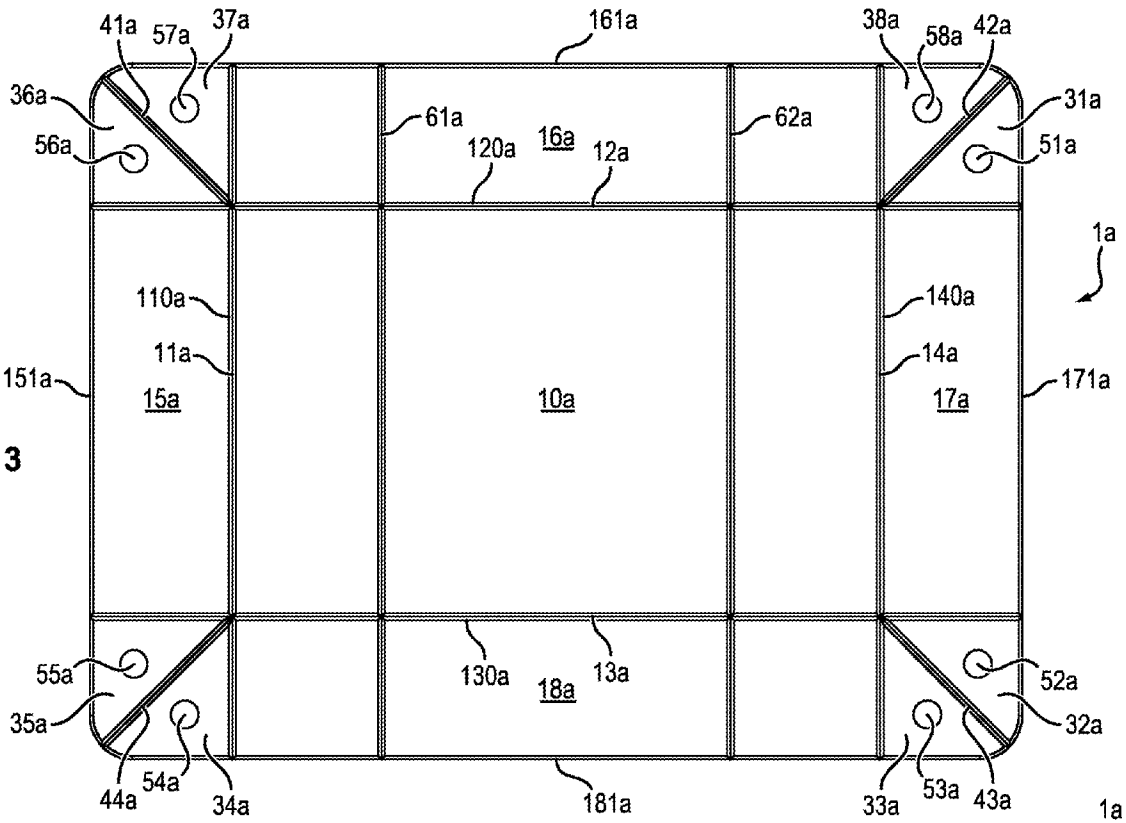
FIG. 3 illustrates a top view of a lid of the invention of a game box according to one embodiment of the invention.

FIG. 3 illustrates a lid 1*a* (or simply a transformable game board 1*a* when it is not intended to be used as a game box lid) of a game box comprising a central part 10*a* comprising four sides 11*a*, 12*a*, 13*a*, 14*a* and side parts 15*a*, 16*a*, 17*a*, 18*a* each being connected to one side 11*a*, 12*a*, 13*a*, 14*a* of the central part 10*a*.

The lid 1*a* is in FIG. 3 in the flat position P0 and has a rectangular shape with rounded corners for aesthetics (see FIG. 3).

Figure 4:
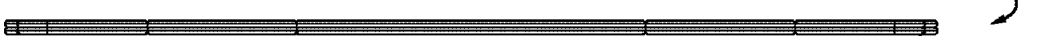
FIG. 4 illustrates a side view of a lid of the invention of a game box according to one embodiment of the invention.

The lid has for example a thickness comprised between 2 and 6 mm. FIG. 4 illustrates a profile view of the lid 1*a*.

The lid can be made of various materials, for example cardboard-based material. Preferably, the lid 1*a* consists of an inner material and an outer material around a base material such as cardboard, PP (polypropylene) or any other plastic. The base material ensures the rigidity of the lid. The external material is generally made of PU leather, but it can also be any type of fabric. Preferably, it is PU leather on one side and microfiber fabric on the other side.

Figure 5:
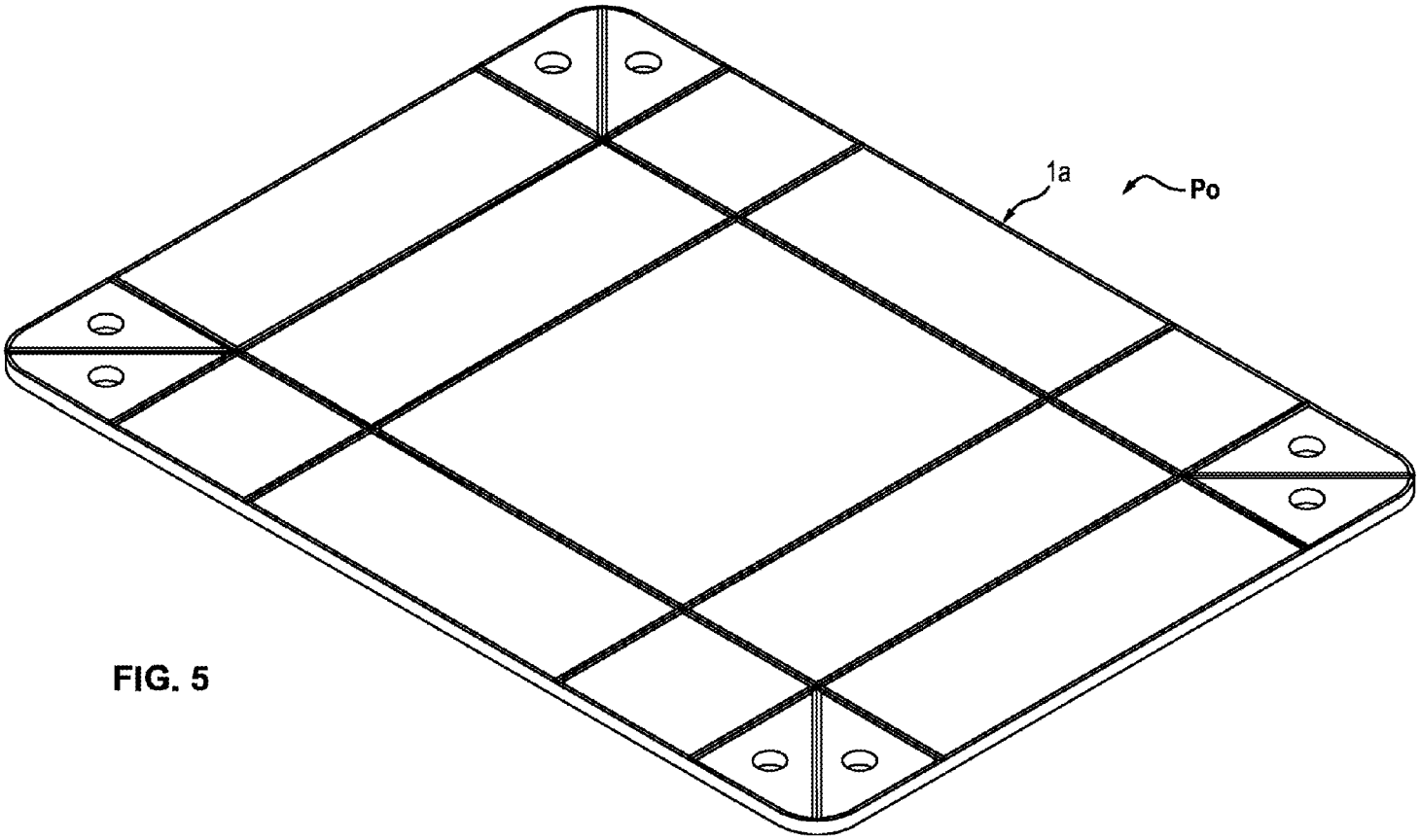
FIG. 5 illustrates a perspective view of a lid of the invention of a game box according to one embodiment of the invention.
Figure 6:
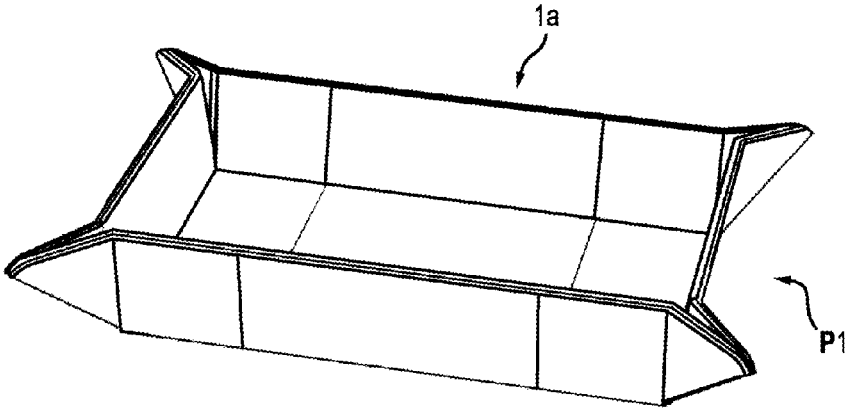
FIG. 6 illustrates a side view of a lid according to one embodiment of a game box of the invention in the game board position.

The sides 11*a*, 12*a*, 13*a*, 14*a* are connected to the side parts such that the side parts 15*a*, 16*a*, 17*a*, 18*a* can switch from a first position P0 (see FIGS. 3 and 5) to a second position P1 (see FIG. 6). In other words, the side parts are movable, the lid being able to be in a first position P0 or a second position P1.

To allow raising the side parts 15*a*, 16*a*, 17*a*, 18*a*, the side parts 15*a*, 16*a*, 17*a*, 18*a* are connected to the central part by means of first fold lines 110*a*, 120*a*, 130*a*, 140*a* constituting fragile areas formed in the thickness of the lid 1*a*.

The possibility of being able to raise the side parts allows switching the lid from a first position P0 to a second position P1 and vice versa and allows using the lid 1*a* as a game board.

FIG. 6 illustrates the lid 1*a* seen from above with the side parts according to the second position P1. In this figure, the lid 1*a* can be used as a game board and particularly as a dice rolling area. The side parts allow preventing dices rolled on the board from escaping.

In order to hold the side parts 15*a*, 16*a*, 17*a*, 18*a* together and to hold the lid according to the second position P1, the lid 1*a* comprises eight holding parts 31*a*, 32*a*, 33*a*, 34*a*, 35*a*, 36*a*, 37*a*, 38*a*. Each of the holding parts is disposed between two side parts 15*a*, 16*a*, 17*a*, 18*a*. Particularly, the holding parts 31*a*, 32*a*, 33*a*, 34*a*, 35*a*, 36*a*, 37*a*, 38*a* are disposed at each corner of the central part 10*a*.

The holding parts 31*a*, 32*a*, 33*a*, 34*a*, 35*a*, 36*a*, 37*a*, 38*a* form in pairs, between each side part 15*a*, 16*a*, 17*a*, 18*a* a square, each diagonal of which forms second fold lines 41*a*, 42*a*, 43*a*, 44*a* making it possible to fold two adjacent holding parts 31*a*, 32*a*, 33*a*, 34*a*, 35*a*, 36*a*, 37*a*, 38*a* onto each other. Thus, two holding parts are clamped together towards the outside of the central part 10*a*. To hold them together, connecting means 51*a*, 52*a*, 53*a*, 54*a*, 55*a*, 56*a*, 57*a*, 58*a* are disposed on each holding part 31*a*, 32*a*, 33*a*, 34*a*, 35*a*, 36*a*, 37*a*, 38*a*.

These connecting means 51*a*, 52*a*, 53*a*, 54*a*, 55*a*, 56*a*, 57*a*, 58*a* can take several forms: magnets or textile strips comprising hooks such as Velcro™ or adhesives or press knobs. Of course, it will be easily understood that two adjacent holding parts comprise complementary connecting means when necessary: magnet, Velcro™, press knob in particular.

In any case, magnets are preferred, indeed, these are simple means that allow switching effortlessly from the first position P0 to the second position P1 and vice versa. Indeed, when the corners are bent, they attract each other so that the lid can form the game board. Conversely, the corners are easily separated to form the lid.

Returning to FIG. 3, the lid 1*a* also comprises third fold lines 61*a*, 62*a* which each extend from one edge 151*a*, 161*a*, 171*a*, 181*a* of one side part to one edge of another side part, facing it, the third fold lines 61*a*, 62*a* making it possible to fold said U-shaped element to form a U-shaped lid for a board game box B as shown in FIG. 2 (lid in a third position P2).

Further possibilities for a lid shape are of course possible, fold lines only need to be provided in other places depending on the desired shape for the lid.

The game element when used independently of the storage tray is advantageously a transformable game board that can be easily stored or transported.

Storage Tray 2*a*

Figure 7:
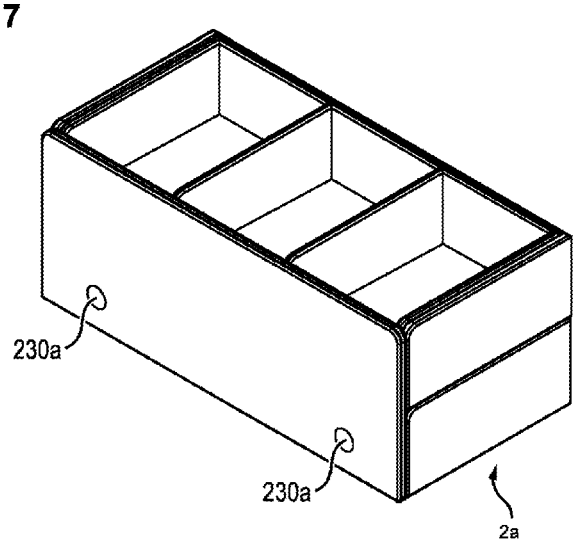
FIGS. 7 and 8 illustrate in perspective a tray of a game box according to one embodiment of the invention.
Figure 8:
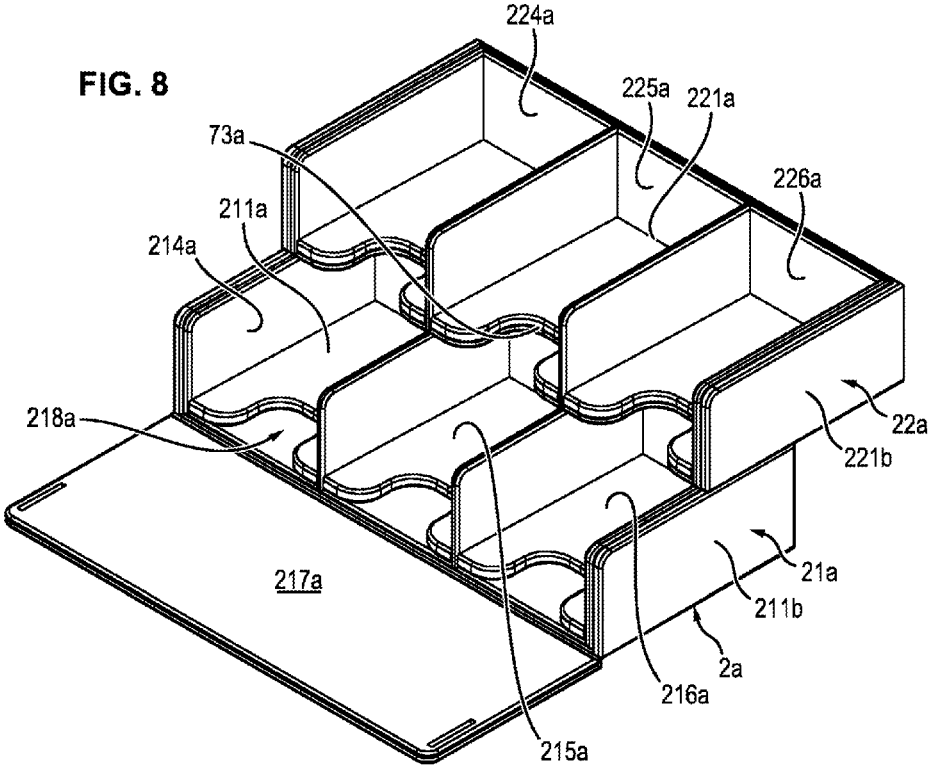

FIGS. 7 and 8 illustrate a tray 2*a* for storing board game equipment. Such a tray 2*a* can be used alone or in combination with the lid 1*a* described above.

The tray 2*a* has a parallelepipedal shape and advantageously comprises a first container 21*a* and a second container 22*a*. The tray 2*a* is made of a cardboard type material. Of course, other shapes can be envisaged and is preferably made of the same material as the lid (see above).

Each container 21*a*, 22*a* comprises a bottom 211*a*, 221*a* and a U-shaped rim 211*b*, 221*b* disposed above the bottom. The rims 211*b*, 221*b* can, for example, be bonded to the bottom 211*a*, 221*b*. Thus, each container has an open part above.

The tray 2*a* has a first position illustrated in FIG. 7 mainly allowing the storage of game equipment and making it possible to receive the lid 1*a* to close the box B.

The two containers 21*a*, 22*a* are disposed one above the other when the tray 2*a* is in the storage position alone. In a complementary manner, the second container 22*a* is movable relative to the first container 21*a* to allow easily accessing the second container 21*a* below. To allow this, the second container 22*a* can simply be disposed above the first container 21*a*. A player can simply unfold the two containers.

However, for practical reasons, the second container 22*a* is movably fixed to the first container 21*a*. It can be simply slidably fixed. Those skilled in the art can use different ways to fix the second container 22*a* to the first container 21*a* in this way: rail system for example, use of flexible materials, shaft mechanisms, axle mechanisms.

Advantageously, these mechanisms for connecting the containers are made invisible for aesthetic reasons.

FIG. 8 illustrates a storage tray 2*a* in which the second container 22*a* is linked to the first container 21*a* so as to allow access to the first container 21*a*. In this way, it is understood that the tray 2*a* can switch from a first position to a second position which allows accessing the game equipment stored in the box B. The first container 21*a* is a lower container while the second container 22*a* is an upper container disposed above the first container 21*a*. The first container 21*a* supports the whole and rests in particular on a support such as a table to be used.

Preferably, the second container 22*a* is fixed to the first container 21*a* in a deployable manner by means of rods connecting the first container to the second container in order to allow deployment of the second container 22*a* relative to the first container 21*a*.

Figure 9:
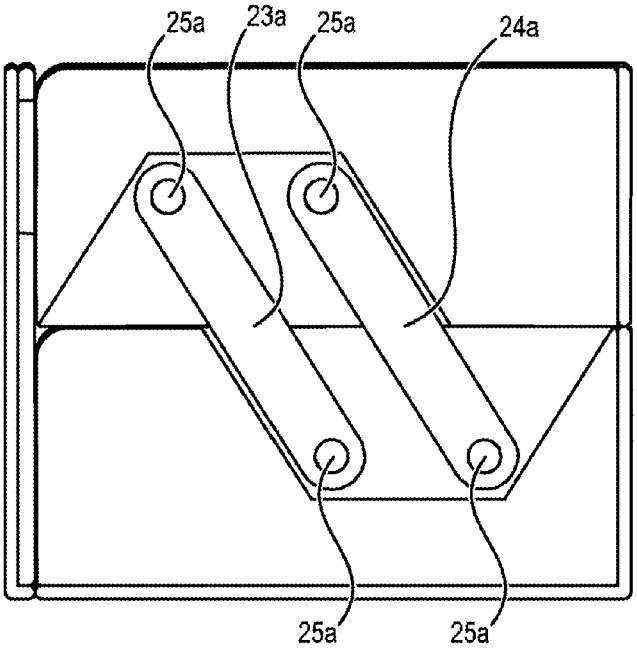
FIG. 9 illustrates a view of the assembly of containers of the tray of a game box according to one embodiment of the invention.

Particularly, two pairs of rods 23*a*, 24*a* connect the first container 21*a* to the second container 22*a*: one pair on each side (only one side is illustrated in FIG. 9.

Figure 10:
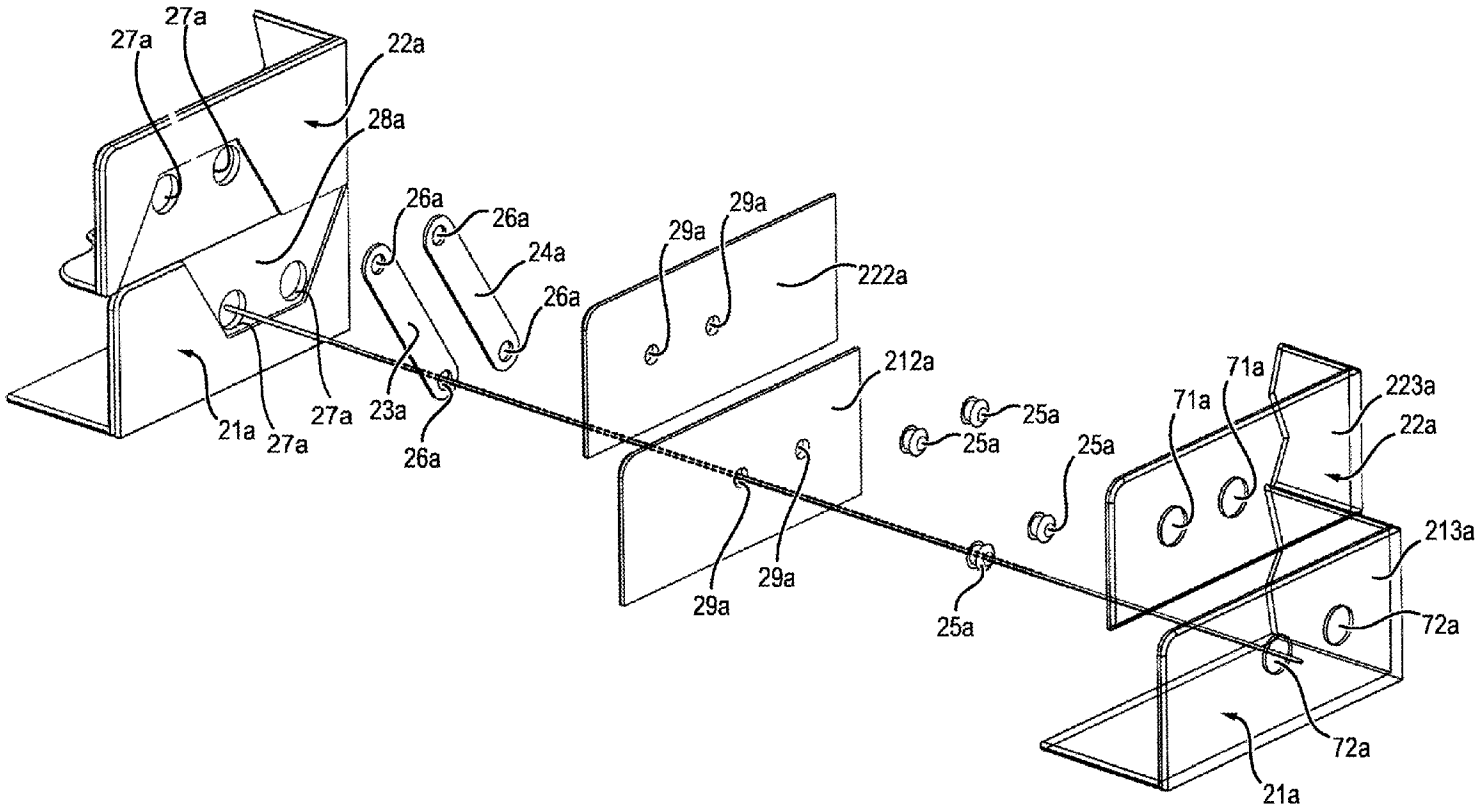
FIG. 10 illustrates the assembly of the containers of the tray of a game box according to one embodiment of the invention.
Figure 11:
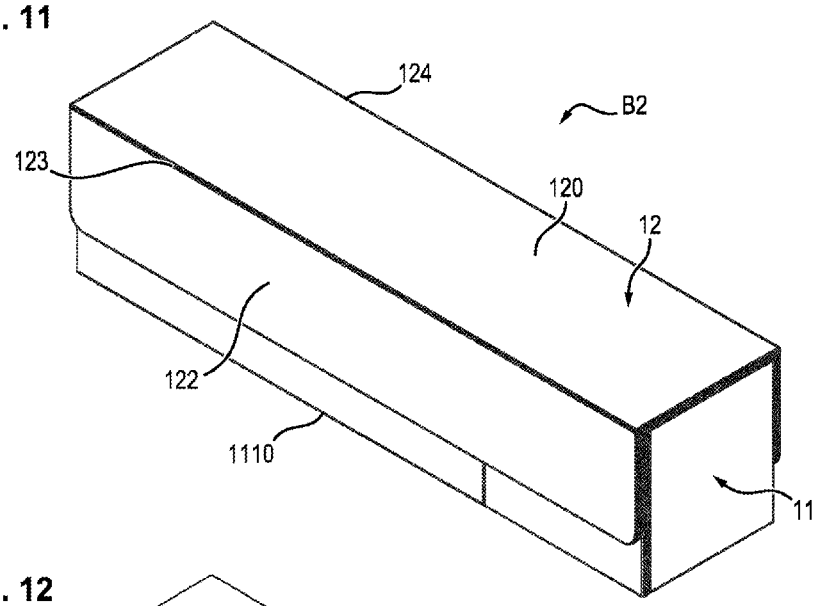
FIG. 11 illustrates an overall view of a box comprising a tray and a lid according to one embodiment in the closed position.

FIG. 10 illustrates a possible connection of the first container 21*a* and second container 22*a* by means of rods 23*a*, 24*a*. The rods 23*a*, 24*a* are fixed to the side walls of each of the two containers 21*a*, 22*a* by means of pins 25*a* extending from orifices 26*a* located at the ends of the rod towards complementary orifices 27*a*. As such, each container 21*a*, 22*a* comprises a cavity 28 adapted to the shape of the rods 26*a*.

In a complementary manner, intermediate plates 212*a*, 222*a* (comprising orifices 29*a*) are disposed on the rods 26*a* and shells 213*a*, 223*a* cover the assembly, the shells 213*a*, 223*a* comprise cavities 71*a*, 72*a*. Thus, the rod mechanism 23*a*, 24*a* is hidden, which gives the tray 2*a* aesthetics, that is to say an improved visual aspect.

In order to allow an orderly storage, each container 21*a*, 22*a* can be compartmentalized (as can be seen in FIG. 8). As such, each container comprises one or several compartment (s) 214*a*, 215*a*, 216*a*, 224*a*, 225*a*, 226*a*. For example, each container 21*a*, 22*a* can comprise three compartments 214*a*, 215*a*, 216*a*, 224*a*, 225*a*, 226*a* of identical shapes and sizes. In the case where the compartments 214*a*, 215*a*, 216*a*, 224*a*, 225*a*, 226*a* are used for the storage of playing cards or dispensers of playing cards, each compartment 214*a*, 215*a*, 216*a*, 224*a*, 225*a*, 226*a* comprises a recess 73*a* formed in the bottom 211*a*, 221*a* of each container 21*a*, 22*a* at the inlet to each compartment 214*a*, 215*a*, 216*a*, 224*a*, 225*a*, 226*a*. The recess 73*a* of each compartment 214*a*, 215*a*, 216*a*, 224*a*, 225*a*, 226*a* allows facilitating access to the playing cards when the container 2*a* is deployed and used as a playing card dispenser (see FIG. 8). Furthermore, each compartment can be tilted such that when it contains cards, these are held still and cannot easily fall out. As such, the bottom of each compartment is tilted backwards.

In a complementary manner, the lower container 21*a* includes magnets 230*a* (the location is shown schematically—FIG. 7) which, advantageously, are not shown for aesthetic reasons. These magnets are provided in sufficient number to allow holding the lid which comprises magnets complementary to those provided on the first container 21*a*. Of course, magnets can be provided on the second container 22*a*.

The tray 2*a* comprises a part 217*a* foldable over the containers 21*a*, 22*a* (FIG. 8). In addition to being able to close the front parts of the containers, this foldable part 217*a* acts as a counterweight so that the storage tray 2*a* is held in position when the container 22*a* is deployed in particular.

Furthermore, the lid 1*a* and the storage tray 2*a* are firmly held together by these magnets.

Second Embodiment

FIGS. 11 to 16 illustrate a game box B2 according to a second embodiment comprising a storage tray 11 according to a second embodiment and a lid 12 which can be transformed into a game board as described above.

Storage Tray 11

The tray 11 comprises a rectangular bottom 1110 common to two storage spaces.

A first storage space is constituted by a compartment 111 comprising longitudinal walls 1111, 1112 perpendicular to the bottom 1110 and side walls 1113, 1114.

The compartment 111 includes a longitudinal intermediate wall 1115 parallel to one of the longitudinal walls 1111. This longitudinal intermediate wall 1115 delimits with the longitudinal wall 1111 a secondary storage space 1116 of small size. Thus, the compartment 111 has a first storage space called main storage space which allows storing most of the game equipment: for example boxes comprising playing cards. This storage space 1116 called secondary storage space allows storing additional equipment, a rule of the game or a particular accessory such as a particular card which requires having its dedicated location. In an advantageous or complementary manner, this secondary storage space 1116 is advantageously divided in two by a side wall 1117.

Figure 12:
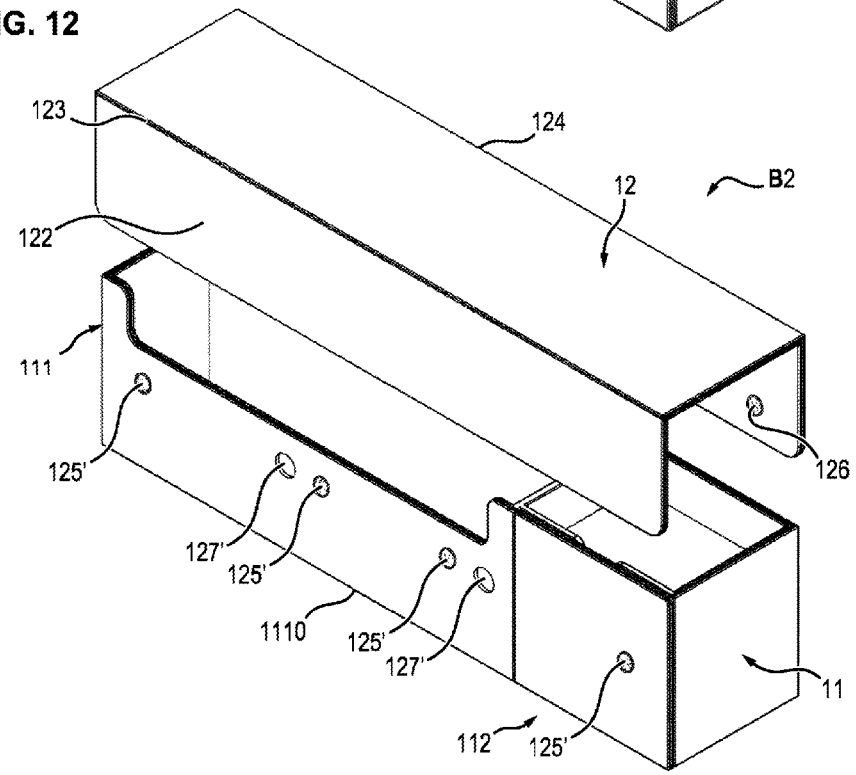
FIG. 12 illustrates an overall view of the box according to one embodiment with the lid detached from the tray.
Figure 13:
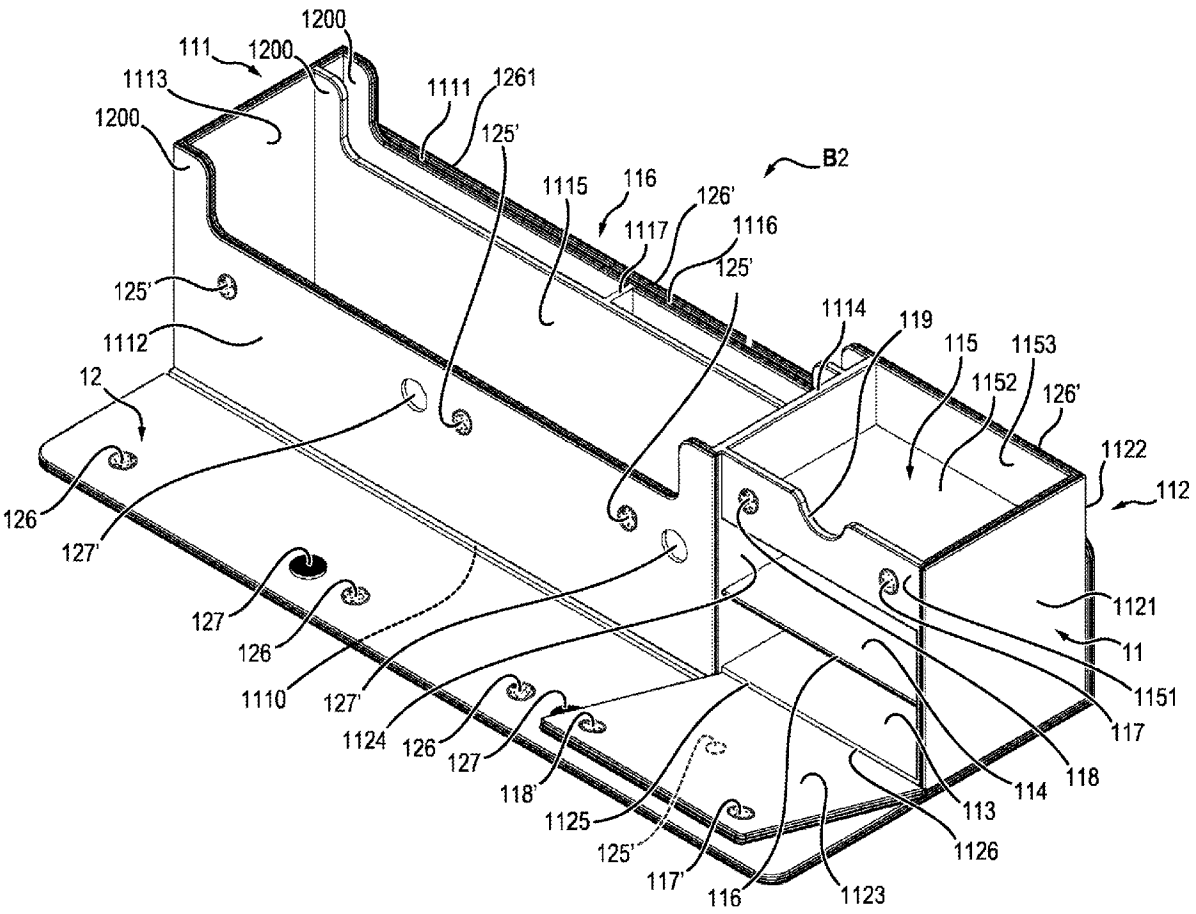
FIG. 13 illustrates an overall view of the box according to one embodiment with the lid detached from the tray and disposed below the tray in the deployed position.

Advantageously and as seen in FIGS. 12 and 13, the longitudinal walls 1112, 1111 comprise cutouts 1200 which allow facilitating access to the contents of the storage tray 11. These cutouts 1200 are rounded to facilitate access to the storage spaces but also to avoid having sharp ridges which could damage the game equipment and in particular the cards.

A second storage space is constituted by a casing 112 and is adjoined to the compartment 111. This casing 112 comprises four walls: two longitudinal walls 1122, 1123 and two side walls 1121, 1124 perpendicular to the bottom 1110. The longitudinal walls 1122, 1123 of the casing 112 are respectively in the extension of the longitudinal walls 1111, 1112 of the compartment 111. The side walls 1121, 1124 of the casing 112 are parallel to the side walls 1113, 1114 of the compartment 111. One of the walls of the casing 111 also belongs to the compartment 112. In FIG. 13, it is a side wall 1114. The casing 112 has locations 113, 114, 115 defined above the bottom: an upper location 115 accessible from above and one or several lower location(s) 113, 114 stacked under the upper assembly 115 (from the top down, down being the bottom). Advantageously, the lower locations 113, 114 are separated by a shelf 116. Alternatively, this shelf 116 can be dispensed with to form a larger location.

As illustrated in FIG. 13, the casing 112 preferably comprises three locations: an upper location 115 and two lower locations 113, 114. The lower locations are advantageously accessible through a longitudinal wall 1123 which is movable relative to the bottom 1110.

The movable wall 1123 allows accessing locations via a front face of the storage tray 11. Particularly, this wall 1123 is movably mounted relative to one side 1125 of the bottom 1110 of the storage tray 11 at the casing 12 to be actuated towards a low position such that it can be parallel to the bottom 1110. In this way, it is easy to access the locations 113, 114.

This mobility is made possible thanks to the fact that the side 1125 of the bottom and the lower side 1126 of the movable wall in contact with the casing 112 form a fold line constituting a fragile area in the thickness of the box in this place. The actuation of the movable wall 1123 is then possible.

Advantageously, the casing 112 comprises means for connecting the movable wall 1123 in order to hold the movable wall 1123 in the high position. The high position of the movable wall is a high position, that is to say perpendicular to the bottom 1110 of the storage tray 11 at the casing 12. In this way, the movable wall 1123 can close the locations of the casing 112. These connecting means can also form means for returning the movable wall 1123 so that it returns to the high position when it is raised.

These connecting means can take several forms: magnets or textile strips comprising hooks such as Velcro™ or adhesives or press knobs.

According to one embodiment, the connecting means also form the return means, these are constituted by magnetized parts 117, 118 disposed on a longitudinal wall 1151 of the upper location 115 and by magnetized parts 117', 118' complementary to those disposed on the upper location 115. In this way, the magnetized parts of the movable wall 1123 and those of the upper location attract each other. Preferably, they attract each other to press the movable wall 1123 against the casing 112. This attraction allows the movable wall 1123, when it starts to be raised, to be easily pressed against the casing 112. Its actuation is therefore easy, the closing of the casing 112 is therefore easy.

The magnetized parts 117, 118, 117', 118' are schematized by circles in the figures but are invisible in practice. Furthermore, other shapes for these magnetized parts can be envisaged.

The upper location 115 has a bottom 1152 and two longitudinal walls 1151, 1153, one of which comprises the magnetized parts 117, 118. A cutout 119, preferably rounded (without sharp ridges—see above) is also provided on the wall 1151 comprising the magnets 117, 118 in order to create a space between the movable wall 1123 and the upper location 115 so as to be able to actuate this movable wall 1123. The connecting and possibly return means are such that when the movable wall is in the high position, it is firmly held to properly close the lower locations. As will have been understood, the fact of preferring magnetized parts for the connecting means is that it also forms means for returning the movable wall 1123 when it is close to the magnetized part of the upper location.

The upper location 115 has a closed area which can for example be used as a dice rolling area during the game.

Lower locations (here two lower locations) of identical sizes are therefore disposed below the upper location 115. These locations are advantageously intended to receive drawers intended to contain game equipment such as cards. In case the shelf 116 is not present, the drawers can be stacked on each other.

A drawer 13 with a movable wall (see FIGS. 14 and 15) comprises a rectangular bottom 130, two longitudinal walls 131, 132 and two side walls 133, 134 perpendicular to the bottom. A longitudinal wall 131 is movably mounted relative to one side 135 of the bottom to be actuated between a high position such that the four walls close the four sides and a low position such that one side 135 is accessible. It is the front face of the drawer. The drawer 13 further comprises connecting means also advantageously forming means for returning the movable wall 131 to bring it back to the high position when it is raised.

These connecting and return means are constituted by intermediate walls 1360, 1370 extending from the side 135 accessible by the movable wall 131, the intermediate walls 1360, 1370 being disposed at each end of the accessible side 135, and are perpendicular to both the bottom 130 and the longitudinal walls 131, 132. The movable wall 131 is in contact with the intermediate walls 1360, 1370 when it is in the high position. The connecting and return means of the movable wall are advantageously constituted by magnetized parts 1361, 1371 disposed on the intermediate walls and by complementary magnetized parts 1361', 1371' disposed on the movable wall 131. In this way, the magnetized parts of the movable wall and those on the intermediate walls attract each other. Preferably, they attract each other to press the movable wall 131 against the intermediate walls. This attraction allows the movable wall, when it starts to be raised, to be easily pressed against the intermediate walls. As will have been understood, the magnetized parts which attract each other are facing each other when the movable wall 131 is in the high position and pressed against the intermediate walls.

Figure 14:
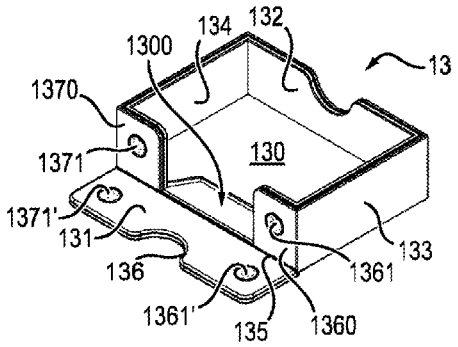
FIG. 14 illustrates a drawer of a box according to the invention with an accessible side.

The magnetized parts are schematized by circles in FIG. 14 but are invisible in practice. Furthermore, other shapes for these magnetized parts can be envisaged.

Advantageously, circular magnets are positioned on each intermediate wall as well as on the movable wall.

In the case where the connecting means do not form return means, these connecting means can take several forms: magnets or textile strips comprising hooks such as Velcro™ or adhesives or press knobs.

As already explained for the casing 112, the fact of providing magnets allows facilitating the handling of the movable wall of the drawer. Indeed, by simply raising the movable wall as soon as it is close to the intermediate walls comprising the magnets, it is attracted by them, which facilitates its handling and therefore the closing of the drawer 13.

Figure 15:
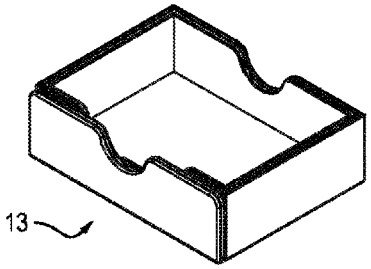
FIG. 15 illustrates a drawer of the box according to the invention with all the sides closed.
Figure 16:
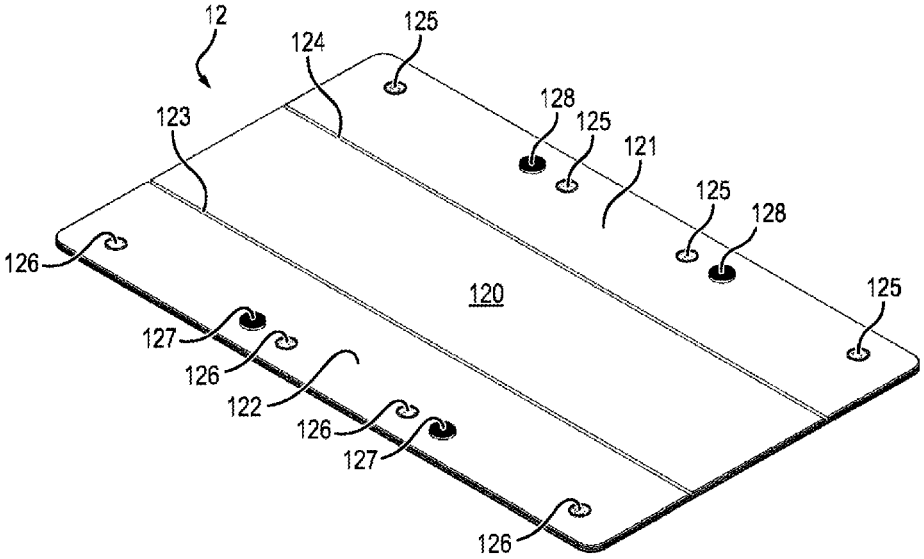
FIG. 16 illustrates a lid of a box according to one embodiment of the invention.

According to one advantageous embodiment, when the four walls of the drawer 13 are in the high position, each cell has the shape of a tray, the movable wall being against the intermediate walls (see FIG. 15).

In a complementary manner, the bottom 130 of the drawer 13 comprises a step 1300 extending from the accessible side 135 such that the bottom 130 comprises a positive elevation from the accessible side.

It is In this way possible, when the drawer 13 comprises cards, to be able to pass a finger in the space defined by the step to grab cards without having to turn over the cell or shake it, which could damage the cards.

Advantageously, the movable wall 131 comprises a central rounded cutout 136 (see FIG. 14). This movable wall 131 can also be used as a tab to pull the drawer 13 from its location in the storage tray 11, if necessary.

The storage tray 11 can be advantageously closed by a lid 12 which comprises a rectangular central part 120 from which rectangular side parts 121, 122 extend. Such a lid 12 can be similar to the lid described above.

The side parts 121, 122 are connected to the central part 120 by fold lines 123, 124 which allow the lid 12 to be in a flat position (see FIGS. 13 and 16) or to have a U-shape (see FIGS. 11 and 12), the side walls 121, 122 being perpendicular to the central part 120 and are therefore raised relative to this central part 120 when the lid 12 forms a U.

These fold lines are fragile areas formed in the thickness of the lid 12. It is therefore understood that the different parts of the lid are arranged together so that the lid can switch from a first position to a second position and vice versa.

In the flat position (see FIGS. 13 and 16), the lid 12 is placed under the storage tray 11 (see FIG. 13) the central part 120 being of a size identical to the bottom 1110 of the storage tray 11. It is understood that the fact of being able to place it under the storage tray 11 allows preventing it from being too bulky when the game is taking place and from having to access the game elements stored in the storage tray 11.

The side parts 121, 122 of the lid 12 have dimensions smaller than the height of the walls of the storage tray 11. The lid in the U-shaped position allows closing the storage tray 11. Holding means 125, 126, 127, 128 are further disposed on the side parts 121, 122 of the lid 12 so that it is firmly attached to the storage tray 11 when it closes the storage tray or when it is under the storage tray 11. These holding means can take several shapes.

According to one embodiment, the holding means consist of magnetized parts 125, 126 disposed on the side walls 121, 122 which are intended to be pressed against the longitudinal walls of the storage tray 11: here two magnetized parts per side wall 121, 122. These holding means also comprise magnetized parts 125', 126' complementary to those disposed on the side walls of the lid but disposed on the longitudinal walls of the storage tray 11 (see FIG. 13). FIG. 13 only clearly shows those disposed on the longitudinal wall 1112 of the storage tray 11, but the other wall comprises the same complementary magnetized parts. According to the first embodiment: four magnetized parts are present.

These holding means can take several forms: magnets or textile strips comprising hooks such as Velcro™ or adhesives or press knobs. The case with magnetized parts is described below, but this also applies to the other alternatives for the holding means.

In a complementary manner, the holding means also comprise knobs intended to be housed in complementary female parts, the knobs constituting the male part. The knobs 127, 128 are advantageously disposed between the magnetized parts of the side walls 121, 122 of the lid 12 on the face intended to be pressed against the storage tray 11. Thus, there can be: a magnetized part, a knob, a magnetized part, a magnetized part, a knob, a magnetized part. The female parts 127' are positioned on the longitudinal walls 1111, 1112 of the storage tray 11 in which the knobs must fit.

The fact of combining the magnetized parts with the knobs allows ensuring that the lid is firmly attached to the storage tray 11, furthermore it allows guiding the user in the positioning of the lid 12 on the storage tray 11.

In this way, the tray 11 is closed and cannot let anything escape. The storage tray 11 and the lid 12 thus constituting a game box B2 which allows storing the game elements firmly and securely. These are in their place and properly held. Furthermore, the lid 12 is completely separable from the storage tray 11. To do so, it suffices to space apart the side walls 121, 122 of the lid of the storage tray 11 thanks to the fold lines and to lift the lid.

Furthermore, the fact of preferring magnetized parts to the other alternatives allows benefiting from the attraction between the different magnetized parts which facilitate the positioning of the lid 12 on the storage tray 11. Also, the lid does not have any direction to be positioned on the storage tray. It must only be ensured that the side walls with the knobs of the lid 12 are positioned to be pressed against the longitudinal walls of the storage tray 11.

According to another alternative embodiment, the holding means are simply constituted by the knobs and therefore without magnetized parts.

It is specified that the combination of the connecting means with the return means can be referred to as "return means" for the sake of brevity.

Third Embodiment

FIGS. 17 to 23 illustrate in particular a game box B3 according to a third embodiment comprising a storage tray 21 and a lid 22.

As can be seen in the figures, the storage tray 21 for this box 2 is advantageously larger than the storage tray 11 of the box B2 according to the second embodiment.

The tray 21 comprises a rectangular bottom 2110 common to two storage spaces (see FIG. 17): a first storage space composed of a compartment 211 and a second storage space is constituted by a casing 212. The two storage spaces are adjoined to each other.

The first storage space comprises side walls 2111, 2112 perpendicular to the bottom 2110 and longitudinal walls 2113, 2114. Advantageously, a removable wall 300 allows adjusting the storage space constituted by the compartment 211. Grooves 301 are formed inside the compartment on the inner faces of the longitudinal walls. The removable wall 300 can be placed in these grooves depending on the desired spaces for the compartment 211. The removable wall 300 when not used can be stored in various places: under the storage tray or in the compartments when the space allows it, even above the cards.

Figure 19:
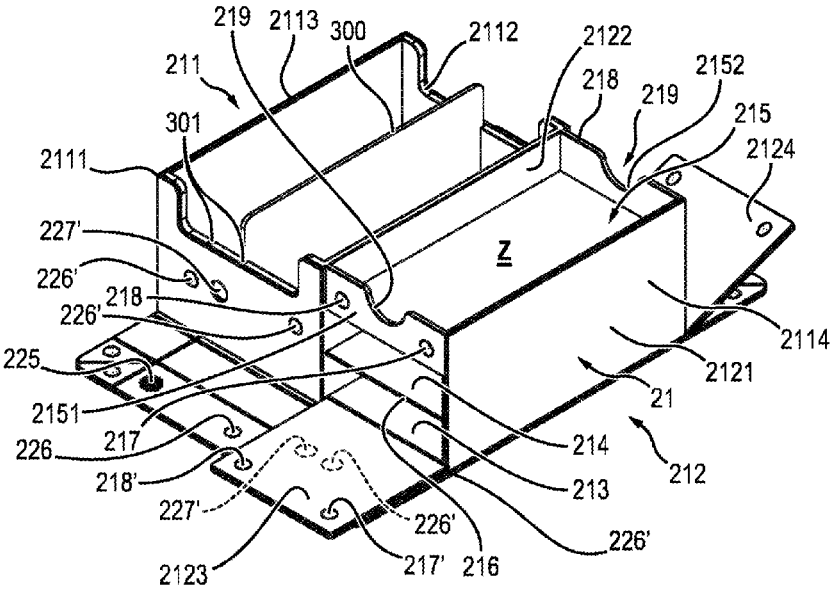
FIG. 19 illustrates an overall view of the box according to one embodiment with the lid detached from the tray and disposed below the tray in the deployed position.
Figure 20:
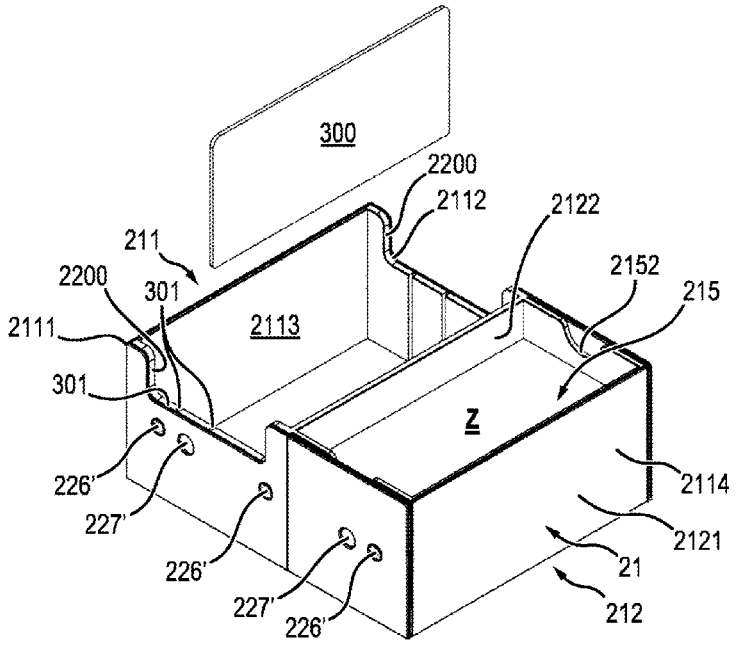
FIG. 20 illustrates an overall view of the tray of the box according to one embodiment.
Figure 21:
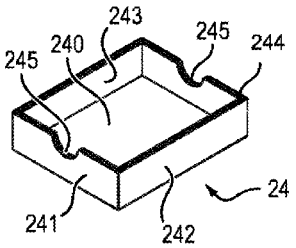
FIG. 21 illustrates a drawer of a box according to one embodiment of the invention.
Figure 22:
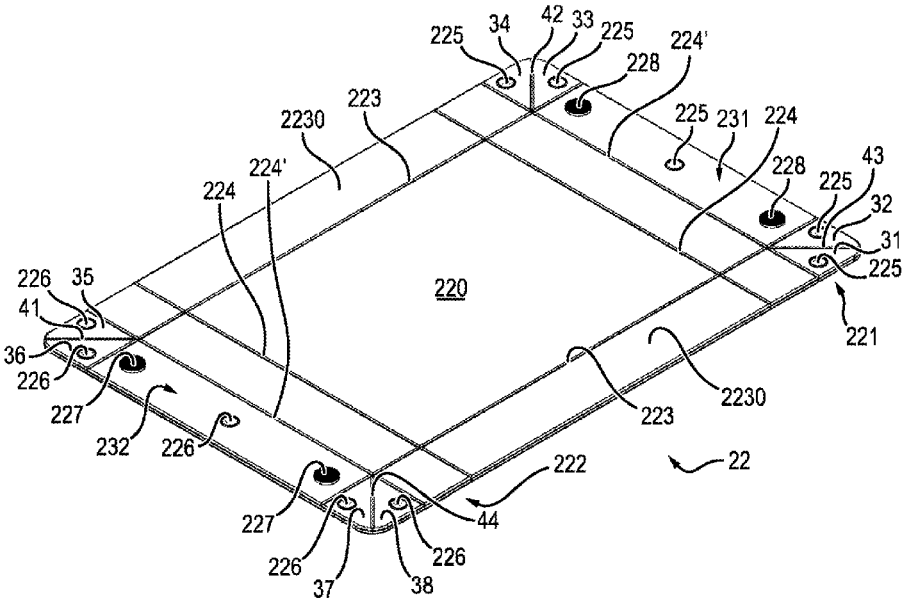
FIG. 22 illustrates a deployed view of a lid convertible into a game board of a box according to one embodiment of the invention.
Figure 23:
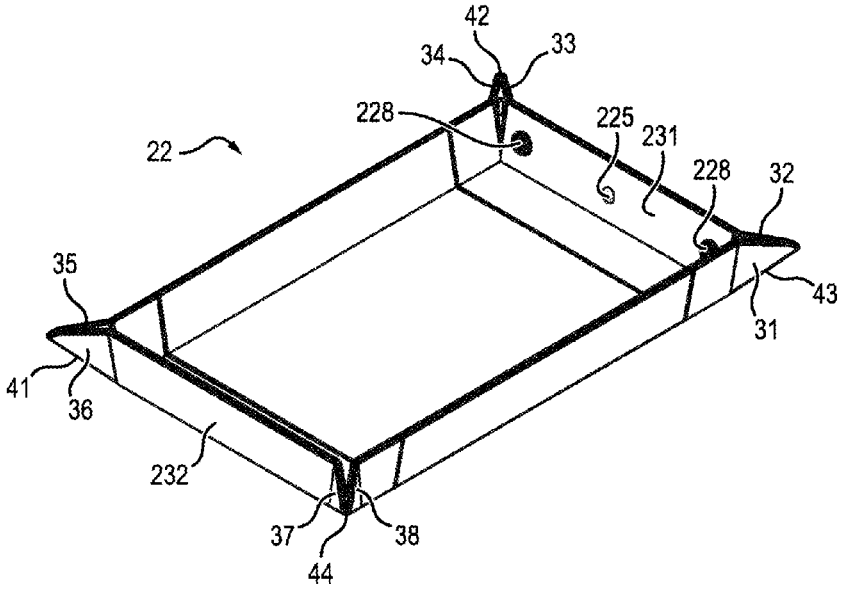
FIG. 23 illustrates a lid in the game board position of a box according to one embodiment of the invention.

Advantageously and as seen in FIGS. 19 and 20, the side walls 2111, 2112 comprise cutouts 2200 which allow facilitating access to the contents of the storage tray. These cutouts 2200 are rounded to facilitate access to the storage spaces but also to avoid having sharp ridges which could damage the game equipment and in particular the cards.

The second storage space comprises four walls: two side walls 2123, 2124 and two longitudinal walls 2121, 2122 connected to the bottom 2110: one of the walls is common with a wall of the compartment 211. As previously, the casing 212 comprises locations 213, 214, 215: an upper location 215 accessible from above and lower locations under the upper assembly (from the top down, down being the bottom). Also, as for the first embodiment, a shelf 216 can be provided to delimit the lower locations 213, 214. This shelf 216 can be dispensed with to form a larger location.

Unlike the second embodiment, the casing 212 has two movable side walls 2123, 2124 which allow accessing the lower locations by two opposite faces of the casing 212. This is advantageous insofar as it is possible to store drawers 13 with a movable wall already described in relation to FIGS. 14 and 15 concerning the box according to the second embodiment. In a complementary manner, it is possible to store drawers 24 which do not have a movable wall (see FIG. 21) this is then referred to as single drawer. Consequently, the box B3 according to the third embodiment can comprise two types of drawers: drawers with movable walls (see FIGS. 14 and 15) or single-walled drawers (see FIG. 21).

The movable walls 2123, 2124 according to this third embodiment are identical to those of the box B2 according to the second embodiment: connecting means preferably forming return means constituted by magnetized parts 217, 218 disposed on a wall 2151, 2152 of the upper location 215, the movable walls 2123, 2124 comprising complementary magnetized parts 217', 218'.

Cutouts 219 are provided on the wall 2151, 2152 comprising the connecting means 217, 218 in order to create a space between each movable wall 2123, 2124 and the upper location so as to be able to actuate the movable wall 2123.

Here again, the connecting means alone can take several forms: magnets or textile strips comprising hooks such as Velcro™ or adhesives or press knobs. In the case where the connecting means 217, 218 are magnetized, they also form return means to bring back the movable wall 2123 when it is actuated.

It will be understood that the movable walls of the boxes according to the first embodiment or the second embodiment have identical structures and identical actuations.

Here again, the upper location has a closed Z area which can be used as a dice rolling area during the game, as a storage area for any equipment necessary for the game: notebook, pen, etc.

The single drawer(s) 24 (see FIG. 21) has/have a rectangular bottom 240 and rectangular walls 241, 242, 243, 244 at the bottom 240. Cutouts 245 are provided on opposite walls which allow grasping the single drawer 24 when it is in the location. The fact of providing opposite cutouts allows not imposing a direction of storage of the single drawer in a location of the casing 212. Of course, a single notch can be provided but in this case the storage of the single drawer will only be facilitated in only one direction.

In a complementary manner, such single drawers 24 can be stored in the locations of the casing of the box according to the first embodiment.

As for the first embodiment, the storage tray 21 can be advantageously closed by a lid 22 of the same type as that of the first embodiment.

Figure 17:
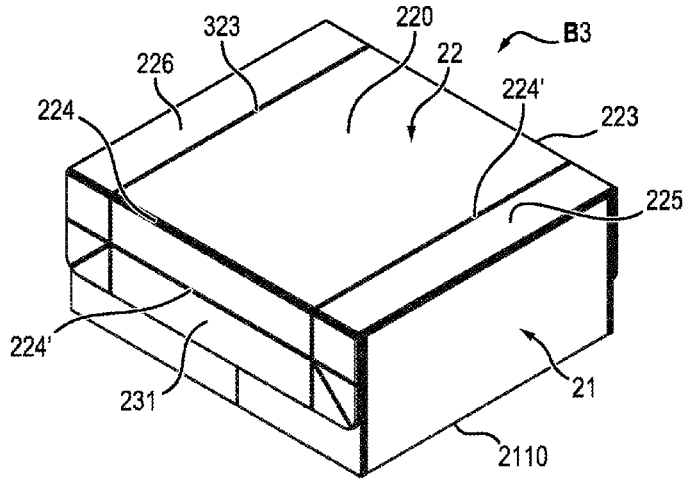
FIG. 17 illustrates an overall view of a box comprising a tray and a lid according to one embodiment in the closed position.
Figure 18:
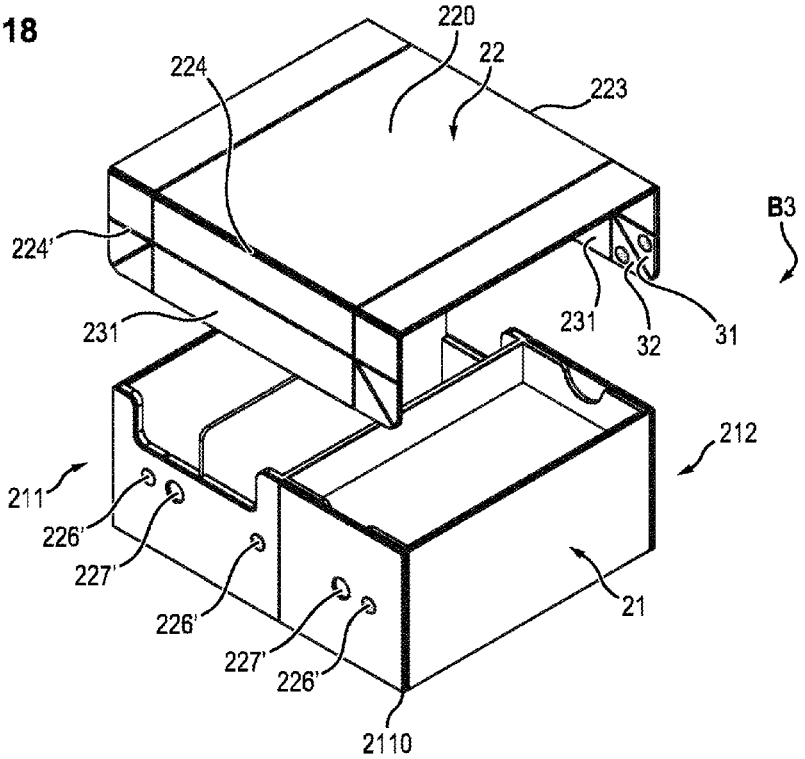
FIG. 18 illustrates an overall view of the box according to one embodiment with the lid detached from the tray.

In FIGS. 17 and 18, the lid is in a position such that it forms a lid for the box 2, in FIG. 19, it is positioned under the storage tray 21 for reasons of space. The lid is here again of the same type as the one described above.

The lid 22 comprises side parts 221, 222 connected to a central part 220 by fold lines 223, 224 which allow the lid 22 to be in a flat position (see FIG. 22) or to have a U-shape (see FIG. 17), the side walls 221, 222 then being perpendicular to the central part 220 and are therefore raised relative to this central part 220 when the lid forms a U.

In the flat position, the lid 22 is placed under the storage tray 21, The lid in the U-shaped position allows closing the storage tray 21. Holding means are further disposed on the side parts 221, 222 of the lid 22 so that it is firmly attached to the storage tray 21 when it closes the storage tray. These holding means are advantageously constituted by magnetized parts 225, 226 making it possible to link the lid 22 to the storage tray 21, the walls of the storage tray 21 comprising complementary magnetized parts 226' which attract those of the lid 22. In FIG. 20, complementary magnetized parts are also present on the wall 2112 but not shown in these figures. These magnetized parts are advantageously coupled to knobs intended to be housed in the complementary female parts, the knobs constituting the male part. The knobs 227, 228 are advantageously disposed on the side parts 221 222 of the lid 22.

The knobs are adapted to be housed in female parts 227' disposed on the side walls of the storage tray 21. In addition, the lid 22 is here again completely separable from the storage tray 21. To do so, it suffices to space apart the side walls 221, 222 of the lid of the storage tray 21 thanks to the fold lines and to lift the lid.

Alternatively, and as previously in particular for the first embodiment, the lid 22 can be transformed into a game board, that is to say it can be used as an area in which the game takes place.

To do so, the side parts 221, 222 comprise secondary fold lines 224' which form side portions 231, 232 of each side part 221, 222 and which also form other side portions 2230 at the central part 220.

These fold lines advantageously allow raising these side portions in order to delimit the playing area.

The lid 22 comprises eight holding parts 31, 32, 33, 34, 35, 36, 37, 38. Each of the holding parts is disposed between two side portions. Particularly, the holding parts 31, 32, 33, 34, 35, 36, 37, 38 are disposed at each corner of the central part 220.

The holding parts 31, 32, 33, 34, 35, 36, 37, 38 form in pairs, between each side portion, a square, each diagonal of which forms fold lines 41, 42, 43, 44 making it possible to fold two adjacent holding parts over each other. Thus, two holding parts are clamped together towards the outside of the central part 220. To hold them together, connecting means are disposed on each holding part.

These holding means can take several forms: magnets or textile strips comprising hooks such as Velcro™ or adhesives or press knobs. Of course, it will be easily understood that two adjacent holding parts comprise complementary holding means when necessary: magnet, Velcro™, press knob in particular.

In any case, magnets are preferred, indeed, these are simple means which allow forming the game board. Indeed, when the corners are bent they attract each other so that the lid 22 can form the game board. Conversely, the corners are easily separated to form the lid.

The lid 22 which can be transformed into a game board can also be used in combination with the storage tray 11 according to the second embodiment by adapting its size.

The box 1, 2 according to one of the embodiments described above is advantageously a cardboard-based box having a thickness comprised between 2 and 6 mm. For aesthetic reasons, the cardboard is advantageously covered with a decorative equipment. Preferably, the box consists of an inner material and an outer material around a base material such as cardboard, PP (polypropylene) or any other plastic. It is understood that the material chosen is sufficiently rigid and solid to be suitable for the storage of game equipment which in the case of playing cards can prove to be quite heavy. The external material is generally PU leather, but it can also be any type of fabric. Preferably, it is PU leather on one side and microfiber fabric on the other side.

The box B3 according to this third embodiment comprises in particular longer drawers for storing accessories: these are single drawers which have fixed walls and which are located at the back of the box B3 (see FIG. 19). This box B3 also comprises "shorter" drawers for storing cards and which have movable walls and which are located at the front of the box B3 (see FIG. 19). Thus, the single drawers are positioned at the back of the box while the drawers with movable walls are positioned in the front.

COMBINATION OF THE EMBODIMENTS

Those skilled in the art will understand that it is easy to combine characteristics of each of the embodiments when technically possible: drawer with a movable wall; single drawer, first storage space that can be modulated by means of a removable wall, intermediate storage space, lid convertible into a game board, different configurations of the storage tray with single drawers or a movable wall.

The invention claimed is:

1. A board game box comprising:

a tray adapted to contain board game equipment; and a game element forming a lid for said tray or game board;

wherein the game element comprises:

a central part comprising four sides;

side parts each being connected to one side of the central part such that the side parts can switch from a first position to a second position:

the first position being a position such that the game element is flat; and the second position being a position where the side parts are raised relative to the central part so that the game element forms a game board for a board game, wherein the game element further comprises a thickness, wherein the side parts are connected to the central part by first fold lines constituting fragile areas in the thickness of the game element, thus allowing raising of the side parts wherein the tray comprises a first container and a second container, the second container being disposed above the first container and is assembled with the first container so as to be movable relative to the first container in order to make the first container accessible; and wherein the second container is movably mounted relative to the first container by rods, at least one rod connecting the first container to the second container in order to allow deployment of the second storage area relative to the first storage area.

2. The board game box according to claim 1, wherein the rods comprise orifices and are connected to the first and second containers by pins forcibly mounted in the orifices of the rods to forcibly hold the rods in corresponding orifices on outer faces of the first and second containers.

3. The board game box according to claim 1, wherein each container comprises compartments adapted to store board game equipment.

4. The board game box according to claim 1, wherein the first container comprises a bottom and edges, one edge being adapted to be unfolded in order to be parallel to the bottom so as to facilitate access to the first container.

5. The board game box according to claim 1, wherein the outer faces of the first container and second container are covered with a shell for hiding the rods.

6. The board game box according to claim 1, wherein the game element forms a U-shaped lid for said tray.

7. The board game box according to claim 1, comprising a drawer, the drawer comprising:

a rectangular bottom;

three walls perpendicular to the bottom and rising respectively from three sides of the bottom;

a fourth wall movably mounted relative to a fourth side to be actuated between a high position such that the four walls close the sides of the bottom and a low position such that one side is accessible; and movable parts for returning the fourth movable wall to bring it back to the high position when it starts to be raised.

8. The board game box according to claim 7, wherein the drawer comprises two intermediate walls extending from the accessible side when the movable wall is in the low position, the walls being disposed at each end of the accessible side, the movable wall being in contact with the intermediate walls when it is in the high position.

9. The board game box according to claim 7, wherein the movable parts for returning the movable wall of the drawer comprise complementary magnetized parts disposed on the intermediate walls and the movable wall such that the movable wall is attracted towards its high position when it is raised.

10. The board game box according to claim 7, wherein the rectangular bottom of the drawer comprises a step extending from the edge of the accessible side such that the bottom comprises a positive elevation from the edge of the accessible side.

11. A board game box comprising:

a tray adapted to contain board game equipment;

a game element forming a lid for said tray or game board;

said game element comprising:

a central part comprising four sides;

side parts each being connected to one side of the central part such that the side parts can switch from a first position to a second position:

the first position being a position such that the game element is flat; and the second position being a position where the side parts are raised relative to the central part so that the game element forms a game board for a board game, wherein the game element comprises a thickness, wherein the side parts are connected to the central part by first fold lines constituting fragile areas in the thickness of the game element, thus allowing raising of the side parts; and wherein said board game box further comprises a drawer, the drawer comprising:

a rectangular bottom;

three walls perpendicular to the bottom and rising respectively from three sides of the bottom;

a fourth wall movably mounted relative to a fourth side to be actuated between a high position such that the four walls close the sides of the bottom and a low position such that one side is accessible; and movable parts for returning the fourth movable wall to bring it back to the high position when it starts to be raised.

* * * * *